US008493002B2

(12) United States Patent
Van Der Veeken et al.

(10) Patent No.: US 8,493,002 B2
(45) Date of Patent: Jul. 23, 2013

(54) DRIVER FOR COOPERATING WITH A WALL DIMMER

(75) Inventors: Renatus Willem Clemens Van Der Veeken, Eindhoven (NL); Henricus Marius Joseph Maria Kahlman, Dongen (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/381,121

(22) PCT Filed: Jun. 22, 2010

(86) PCT No.: PCT/IB2010/052818

§ 371 (c)(1), (2), (4) Date: Dec. 28, 2011

(87) PCT Pub. No.: WO2011/001327

PCT Pub. Date: Jan. 6, 2011

(65) Prior Publication Data

US 2012/0104851 A1 May 3, 2012

(30) Foreign Application Priority Data

Jun. 29, 2009 (EP) ..... 09164026

(51) Int. Cl.
*H05B 37/02* (2006.01)

(52) U.S. Cl.
USPC ..... 315/307; 315/200 R; 315/209 R; 315/225; 315/291

(58) Field of Classification Search
USPC ..... 315/200 R, 209 R, 224, 225, 287, 315/291, 294, 307
See application file for complete search history.

(56) References Cited

U.S. PATENT DOCUMENTS

| | | | | |
|---|---|---|---|---|
| 6,661,185 | B2 * | 12/2003 | Kominami et al. | 315/291 |
| 6,870,327 | B2 * | 3/2005 | Takahashi et al. | 315/248 |
| 7,019,469 | B1 | 3/2006 | Thurk et al. | |
| 2004/0207337 | A1 | 10/2004 | Fischer et al. | |
| 2005/0012472 | A1 * | 1/2005 | Soehnel | 315/291 |
| 2006/0132061 | A1 * | 6/2006 | McCormick et al. | 315/291 |
| 2007/0182347 | A1 | 8/2007 | Shteynberg et al. | |
| 2008/0258647 | A1 | 10/2008 | Scianna et al. | |
| 2011/0101877 | A1 * | 5/2011 | Zhan et al. | 315/206 |
| 2011/0121754 | A1 * | 5/2011 | Shteynberg et al. | 315/294 |

FOREIGN PATENT DOCUMENTS

| | | | |
|---|---|---|---|
| WO | 2005115058 | A1 | 12/2005 |
| WO | 2006120629 | A2 | 11/2006 |
| WO | 2008059308 | A1 | 5/2008 |

* cited by examiner

*Primary Examiner* — Douglas W Owens
*Assistant Examiner* — Thai Pham
(74) *Attorney, Agent, or Firm* — Van Ernest; Mark L. Beloborodov

(57) ABSTRACT

A driver (100; 200) for driving a dimmable load (L) is powered from phase-cut mains (U1) and determines the dimming state of the load on the basis of the phase of the cutting of the mains. The driver comprises: a load current generating device (130; 230) generating load current; a controllable auxiliary load (170; 270) connected to an input (131; 231) of the load current generating device; a control device (140; 240) controlling the auxiliary load. The control device has an input (141; 241) receiving a signal indicating the momentary voltage at the driver input. The load current generating device generates interrupted current pulses, so that the average output current corresponds to the dim command reflected by the phase cutting angle of the input mains. The control device switches the auxiliary load on during those time periods when the output current generated by the load current generating device is zero.

17 Claims, 4 Drawing Sheets

DRIVER FOR COOPERATING WITH A WALL DIMMER

FIELD OF THE INVENTION

The present invention relates in particular to a driver for driving light sources, especially LEDs, but the driver of the invention can be applied for driving any type of load.

BACKGROUND OF THE INVENTION

In conventional lighting applications, incandescent lamps are used, which are based on resistive heating of an light-emitting element. The lamps are powered from mains, which in Europe involves 230 V AC at 50 Hz. Conventionally, such lamps are connected in series with an ON/OFF switch, so that the lamps are either off or produce light at a nominal power. To meet the demand of being able to dim the lamp, i.e. to reduce the light level, mains dimmers have been developed as a device being connected in series with the lamp, either as a separate device or integrated with the wall-mount switch. Such dimmers typically operate on the basis of phase-cutting the mains voltage, using a TRIAC. Since such dimmers are commonly known, the following description will be kept brief.

FIG. 1A is a graph schematically showing voltage (vertical axis) versus time (horizontal axis) of rectified mains. It can be seen that this voltage follows a continuous sine-shaped curve, of which the negative portions are inverted. The power provided to a resistive load, expressed as $P=U^2/R$, can be considered as being proportional to the surface area under the curve.

FIGS. 1B and 1C are comparable graphs showing the output voltage of phase-cutting dimmers, i.e. a leading edge dimmer (FIG. 1B) or a trailing edge dimmer (FIG. 1C). In the case of a leading edge dimmer (FIG. 1B), the output voltage is suppressed to remain zero immediately after a zero-crossing of the mains, until a certain phase $p_X$ between 0 and 180° when the voltage makes a jump to follow the mains curve. Again, the power provided to a resistive load can be considered as being proportional to the surface area under the curve: it can be seen that this power is reduced when said phase $p_X$ is increased (righthand side of the curve). In the case of a trailing edge dimmer (FIG. 1C), the voltage follows the mains after a zero-crossing until a certain phase $p_Y$ between 0 and 180° when the voltage is suppressed to make a jump to zero. Again, the power provided to a resistive load can be considered as being proportional to the surface area under the curve: it can be seen that this power is reduced when said phase $p_Y$ is decreased (lefthand side of the curve). The situation of FIG. 1B is indicated as "leading edge dimming" and the situation of FIG. 1C is indicated as "trailing edge dimming".

One problem with incandescent lamps is their low efficiency: much of their power consumption goes wasted in the form of heat. Alternative light sources have been developed with much higher efficiency, such as for instance gas discharge lamps, LEDs, OLEDs, etc. For producing the same amount of light, such light sources require much less electrical energy, for which reason they can be termed "energy-saving lamps". Such light sources can not be operated by direct connection to mains: they need to be driven by a driver device which in turn is powered from mains. Drivers include the CuFe ballast for TL lamps, but the present invention relates to electronic drivers. As will be commonly known to persons skilled in the art, such electronic drivers have been developed for on the one hand presenting a suitable load to mains (power factor correction) and on the other hand generating a suitable output current for the light source. The driver may be designed for controlling the current magnitude, but may also be designed for controlling the output power.

It is also desirable to be able to dim an energy-saving lamp, so dimmable electronic drivers have also been developed. Such driver has a user control input, typically wirelessly coupled to a remote control, via which a user may control the light intensity, i.e. dim the light source. In such case, dimming is performed by the driver, by reducing the output current intensity (amplitude) or reducing the PWM duty cycle of the lamp current.

"Normal" dimmable electronic drivers are intended for being powered from "normal" mains, i.e. a sine-shaped voltage of for instance 230 V 50 Hz in Europe. However, there are also situations where it is desirable to be able to dim the lamp by using a mains dimmer. Such situation may typically occur when an existing light source is replaced by a light source with integrated electronic driver, when the existing light source is for instance an incandescent lamp powered via a wall-mounted dimmer. Electronic drivers capable of receiving "dimmed" mains from a mains dimmer have also been developed: such drivers can be described as operating as normal drivers as far as generating current for the lamp is concerned, yet having the further facility of analysing the phase angle of the input mains and determining the dim level for the lamp on the basis of this information.

FIG. 2 is a block diagram of a practical situation where an electronic lamp driver 20 is connected to "dimmed mains" provided by a mains dimmer 10 operating according to the above-described phase-cutting principle. The dimmer 10 has an input 11 receiving the original mains, and an output 12 providing dimmed mains $V_D$. The mains dimmer 10 has a user input 13 for controlling the dim level, typically a rotating knob. In a common situation, the mains dimmer 10 is wall-mounted while a lamp L supplied by the mains dimmer 10 is mounted relatively remote, illustrated by the long supply lines 14. The lamp L is provided with an electronic driver 20, either as a separate device or as a built-in device, having an input 21 connected to the supply lines 14 to receive the dimmed mains $V_D$, and having an output 22 connected to the actual light source of the lamp L.

SUMMARY OF THE INVENTION

A problem in such circuit relates to the fact that the mains dimmer 10 comprises an output stage with a TRIAC 15. As should be known to a person skilled in the art, a TRIAC switches off when the current drops below a certain level indicated as hold current; this level may depend on the individual TRIAC. Consequently, the output current of the dimmer 10 is switched off before the voltage crosses zero. Further, a TRIAC needs a certain ignition current, also indicated as latching current, to switch on. All in all, basically, a mains dimmer only operates properly above a certain level of output current, and mains dimmers have typically been developed for a minimum output power of about 30 W. Energy-saving lamps typically consume less than 30 W, particularly in the case of lamps used in consumers' houses. When the lamps are dimmed, the problem only gets worse. The lamp may not start, the lamp may extinguish, the lamp may show erratic behaviour and visible flickering and audible humming, etc. This is obviously unacceptable to the users and hinders the acceptance of energy-saving lamps.

An object of the present invention is to overcome or at least reduce the above problems.

In one embodiment, the present invention provides an electronic driver for cooperating with a mains dimmer. The driver generates duty cycle controlled current for the lamp, which means that the lamp current is switched on and off while the ratio between ON-time and current period determines the average output current and hence the average output light. During those periods when the lamp current is off, an auxiliary impedance is coupled to the mains such as to draw a current from the mains dimmer to satisfy the requirements for maintaining the TRIAC.

In another embodiment, the present invention provides an electronic driver for cooperating with a mains dimmer. The driver generates high-frequency lamp current during those periods when the mains voltage is higher than zero. During those periods when the mains voltage is zero, an auxiliary impedance is coupled to the mains such as to draw a current from the mains dimmer to satisfy the requirements for maintaining the TRIAC. Further advantageous elaborations are mentioned in the dependent claims.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, and in which.

DETAILED DESCRIPTION OF THE INVENTION

Figure 1A:
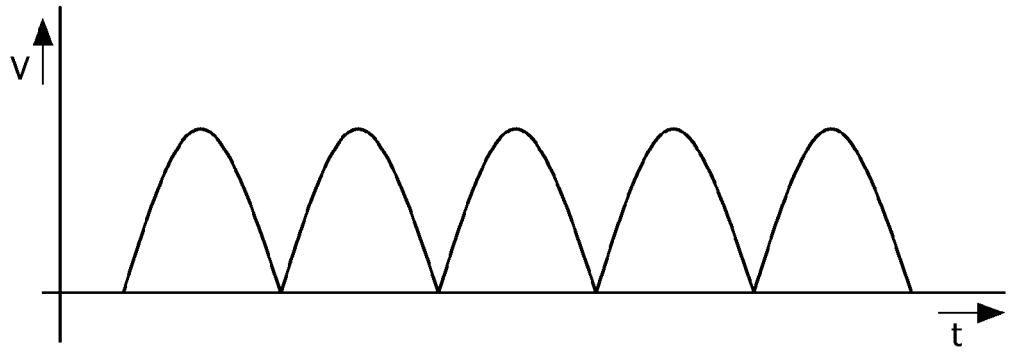
FIGS. 1A-1C are graphs schematically showing voltage versus time.
Figure 1B:
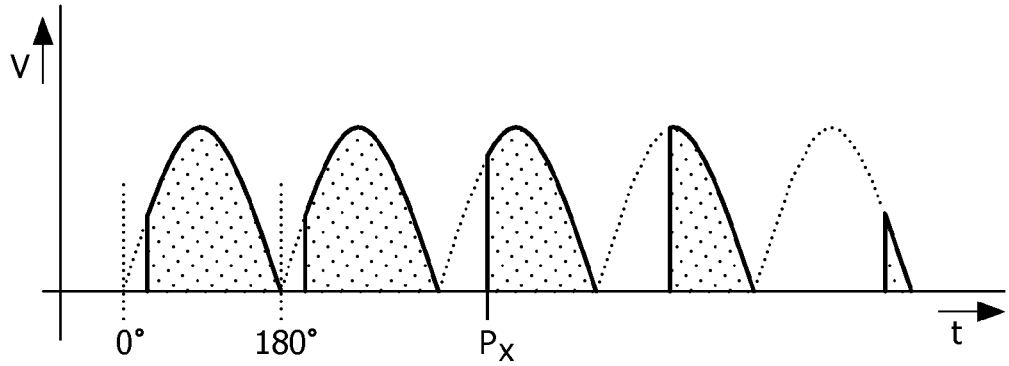
Figure 1C:
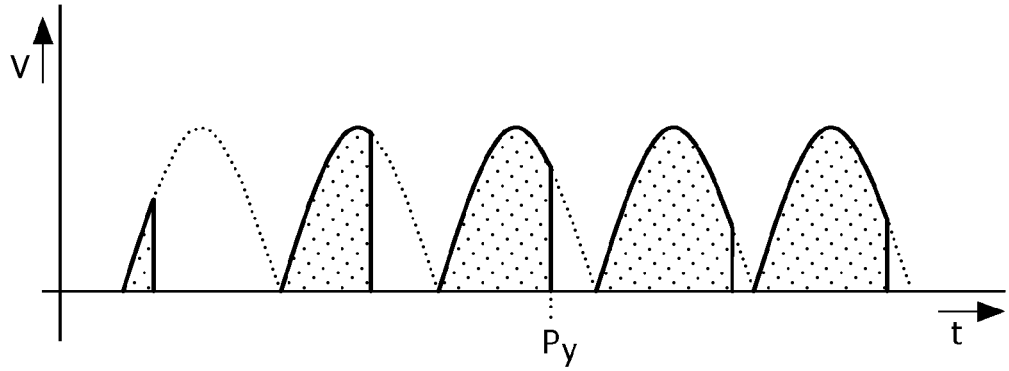
Figure 2:
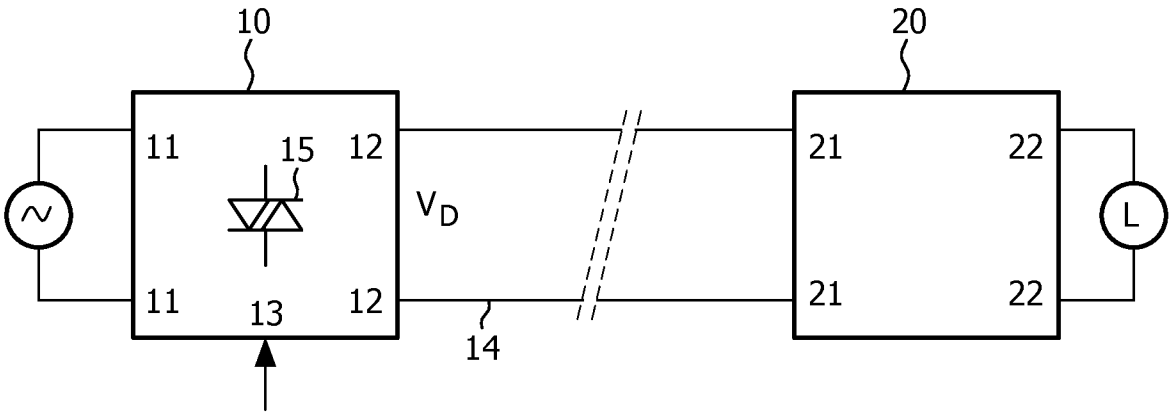
FIG. 2 is a block diagram of an electronic lamp driver connected to a mains dimmer.
Figure 3:
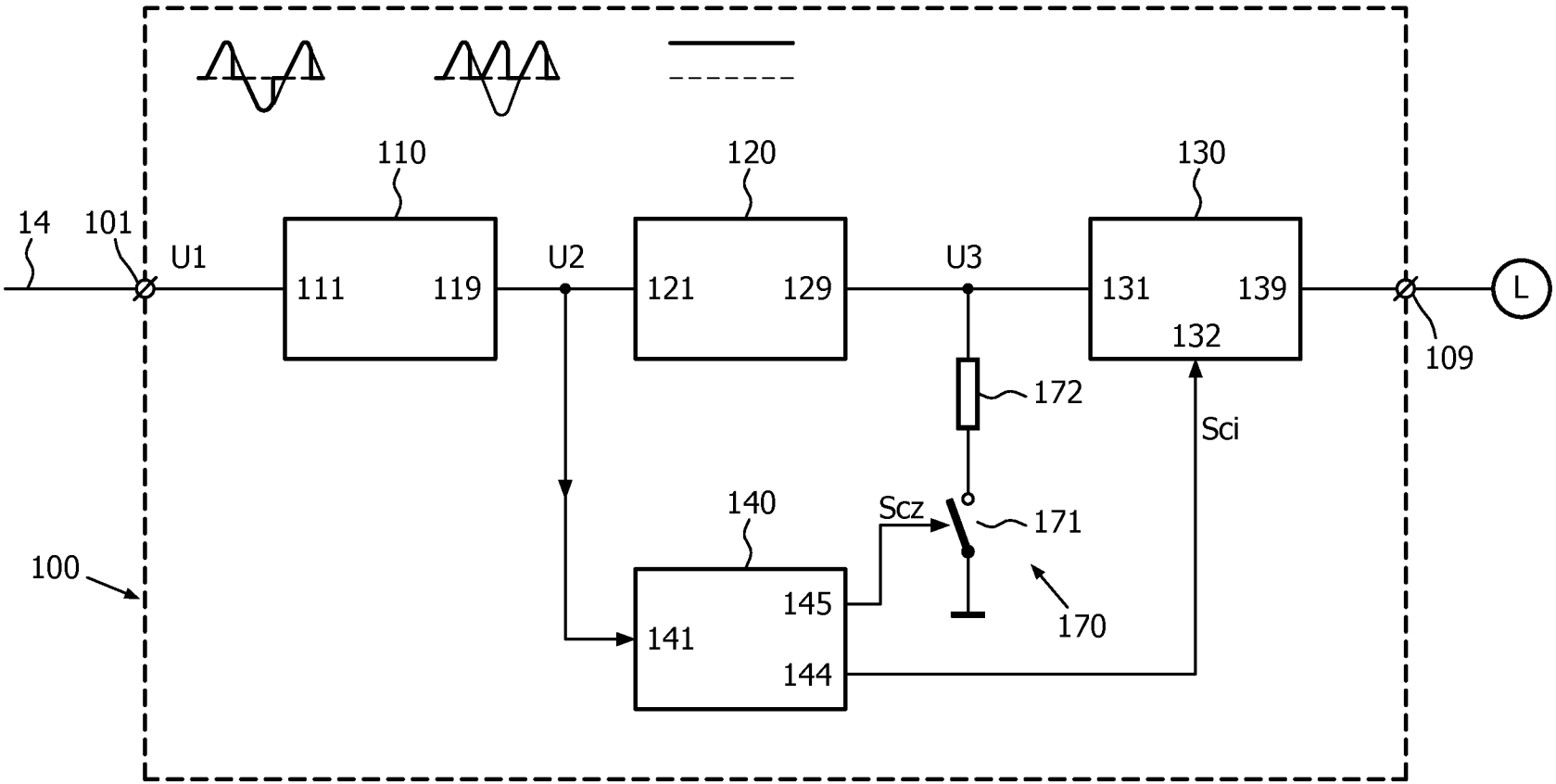
FIG. 3 is a block diagram schematically illustrating one embodiment of an electronic driver according to the present invention.

FIG. 3 is a block diagram schematically illustrating one embodiment of an electronic driver 100 according to the present invention. The driver 100 has an input 101 for receiving phase-cut mains U1 from a mains dimmer (not shown), and has an output 109 for connecting to a lamp L.

A rectifier 110 has an input 111 connected to the driver input 101, and has an output 119 for providing rectified mains U2. The rectifier 110 may for instance be implemented as a diode bridge. It is noted that rectified mains U2 has basically the same wave form as mains U1, with the exception that the polarity of all current half-periods is now the same. Since rectifiers are commonly known to persons skilled in the art, a more detailed discussion of design and operation of the rectifier 110 is not needed here.

A DC/DC converter 120 has an input 121 connected to the rectifier output 119, and has an output 129 for providing substantially constant output voltage U3. Since DC/DC converters are commonly known to persons skilled in the art, a more detailed discussion of design and operation of the DC/DC converter 120 is not needed here.

A controllable interruptor 130 has an input 131 connected to the DC/DC converter output 129, and has its output 139 connected to the driver output 109. The interruptor 130 has two operative states, i.e. a conductive state and a non-conductive state. The interruptor 130 has a control input 132 and is responsive to a control signal received at this control input to operate either in its conductive state or in its non-conductive state. In a simple embodiment, the interruptor 130 may be implemented as a switch. It should be clear that the lamp L is receiving lamp current or not, depending on the operative state of the interruptor 130.

A control device 140 has an input 141 coupled to the rectifier output 119, and has a first output 144 for providing a first control signal Sci to control input 132 of the interruptor 130. For reducing the voltage level at the input 141, the control device 140 may be provided with a resistive voltage divider (not shown), as should be clear to a person skilled in the art. The control device 140, which may be implemented for instance as a suitably programmed controller or microprocessor, is designed to generate its first control signal Sci as a binary signal having one of two possible values, which for simplicity will be indicated as high or low, respectively. If the signal has a first value, for instance high, the interruptor 130 is in its conductive state; if the signal has the second value, for instance low, the interruptor 130 is in its non-conductive state. Switching between the two signal values is assumed to be executed at a constant switching frequency f, although this is not essential. The exact value of this frequency is not important for implementing the present invention, but may typically be in the range of 1 kHz or higher. It should be clear that this switching frequency f determines the frequency of the lamp output current frequency. A lamp current period T is defined as $T=1/f$. In each current period, the current is ON for a certain duration t1 and OFF for a certain duration t2, with $t1+t2=T$. A duty cycle $\Delta$ is defined as $\Delta=t1/T$. The duty cycle can basically be varied between 0% and 100%, and determines the average current level and average output light level.

As explained above, the phase angle of the cutting of the mains determines the required output light level. Thus, the control device 140 is designed to analyse the signal received at its input 141, and to set the duty cycle $\Delta$ of its first control signal Sci in relation to the phase cut angle of the mains signal received at its input 141.

During t2, the interruptor 130 is not providing any current to the lamp L and thus is not drawing any current from mains U1. As explained above, this might lead to problems with the mains dimmer. According to the present invention, these problems are avoided by a switchable auxiliary load 170 connected between the DC/DC converter output 129 and ground. The switchable load 170 may suitably be implemented as a series arrangement of an auxiliary impedance 172 and a controllable switch 171.

The control device 140 has a second output 145 for providing a second control signal Scz for a control input of the controllable switch 171, which may for instance be implemented as a FET. The switch 171 has two operative states, i.e. a conductive state and a non-conductive state. The second control signal Scz is generated as the inverted first control signal Sci, so that the switch 171 is in its conductive state when the interruptor 130 is in its non-conductive state and vice versa. Thus, as an alternative, the second control signal Scz may be provided by an inverter receiving the first control signal Sci as input signal.

As a result, the auxiliary impedance 172 is drawing a current from mains during t2 when the lamp L is not drawing any current, such as to assure a minimum current for the TRIAC in the mains dimmer. The auxiliary impedance 172 can for instance be a resistor, and its value depends among other things on the nominal lamp power and on the characteristics of the mains dimmers to be expected. By way of example, in a suitable embodiment, for a case where U3 is about 400 V and the lamp L has a nominal power of 20 W, a resistance value of 50 kΩ is sufficient.

It is noted that the auxiliary impedance 172 is only drawing a current from mains during dimming; if the lamp is operated at a duty cycle of 100% (full nominal power), no extra losses are introduced.

Figure 4:
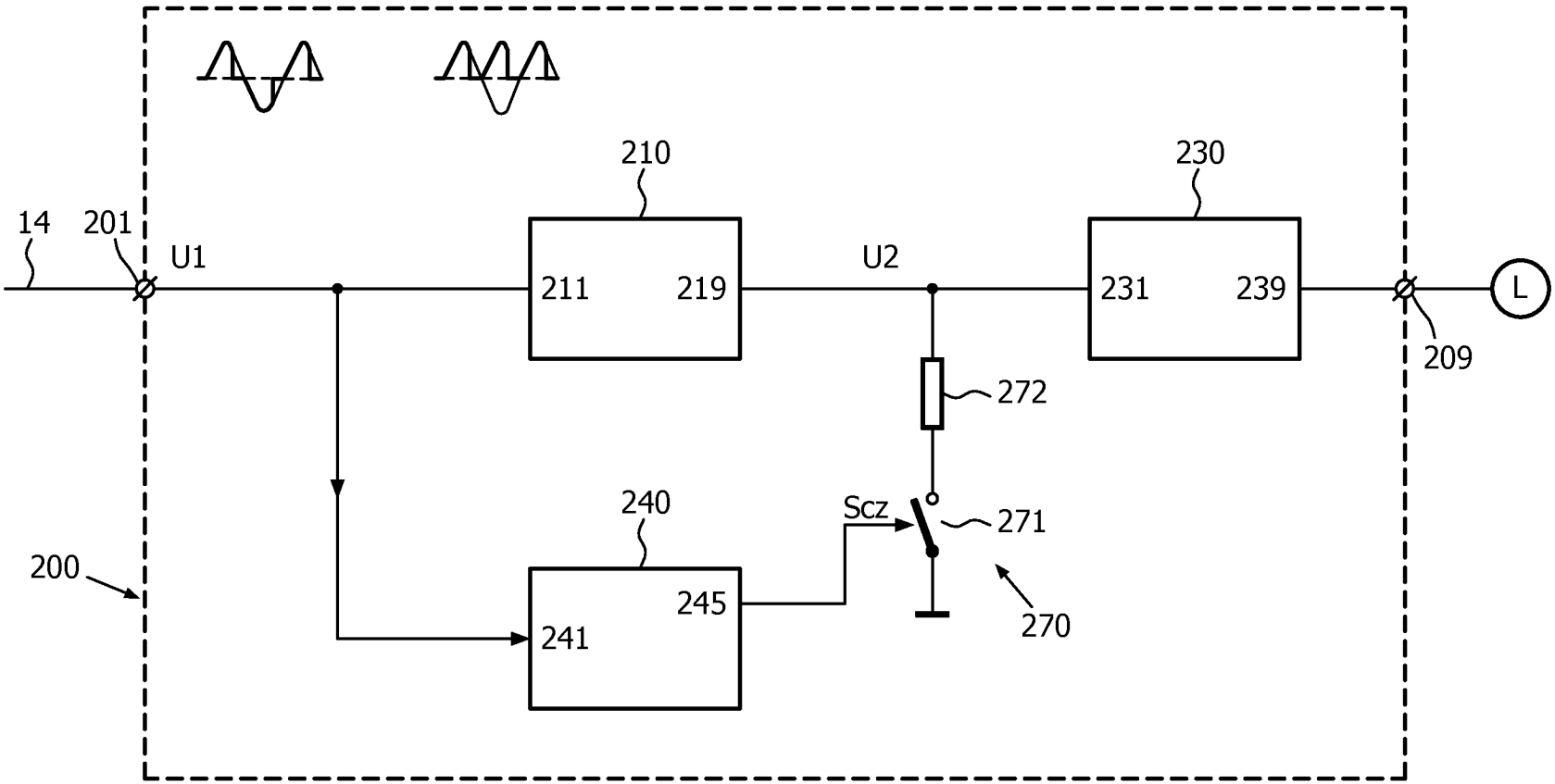
FIG. 4 is a block diagram schematically illustrating a second embodiment of an electronic driver according to the present invention.

FIG. 4 is a block diagram schematically illustrating a second embodiment of an electronic driver 200 according to the present invention. The driver 200 has an input 201 for receiving phase-cut mains U1 from a mains dimmer (not shown), and has an output 209 for connecting to a lamp L.

A rectifier 210 has an input 211 connected to the driver input 101, and has an output 219 for providing rectified mains U2. The rectifier 210 may for instance be implemented as a diode bridge. It is noted that rectified mains U2 has basically the same wave form as mains U1, with the exception that the polarity of all current half-periods is now the same. Since rectifiers are commonly known to persons skilled in the art, a more detailed discussion of design and operation of the rectifier 210 is not needed here.

An inverter 230 has an input 231 connected to the rectifier output 219, and has its output 239 connected to the driver output 209. The inverter 230 is capable of generating an alternating output current, typically by commutating its input voltage. In an embodiment, the inverter 230 may have a full-bridge design, as known per se. It should be clear that the inverter 230 is only providing lamp current when the mains voltage is present, so there is no current when the mains voltage is cut. Thus, the average lamp current and hence the average light output depends on the phase cut angle.

Since there is no lamp current when the mains voltage is cut, this might lead to problems with the mains dimmer, as explained above. According to the present invention, these problems are avoided by a switchable auxiliary load 270 connected between the rectifier output 219 and ground. The switchable load 270 may suitably be implemented as a series arrangement of an auxiliary impedance 272 and a controllable switch 271. The switch 271 has two operative states, i.e. a conductive state and a non-conductive state. For controlling the switch 271, the driver 200 further comprises a control device 240 having an output 245 for providing a control signal Scz for a control input of the controllable switch 271, which may for instance be implemented as a FET.

The control device 240 has an input 241 coupled to the driver input 201. For reducing the voltage level at the input 241, the control device 240 may be provided with a resistive voltage divider (not shown), as should be clear to a person skilled in the art. The control device 240, which may be implemented for instance as a suitably programmed controller or microprocessor, is designed to generate its control signal Scz as a binary signal having one of two possible values, which for simplicity will be indicated as high or low, respectively. If the signal has a first value, for instance high, the switch 271 is in its conductive state; if the signal has the second value, for instance low, the switch 271 is in its non-conductive state.

The control device 240 is designed to analyse the signal received at its input 241, and to detect the zero-crossings in the dimmed mains U1. The control device 240 is designed to generate its output control signal Scz such that it becomes high when the dimmed mains U1 becomes zero or somewhat earlier, and such that it becomes low when the dimmed mains U1 rises from zero or somewhat later. As a result, the auxiliary impedance 272 is drawing a current from mains during those time periods when the lamp L is not drawing any current, such as to assure a minimum current for the TRIAC in the mains dimmer.

The auxiliary impedance 272 can for instance be a resistor, and its value depends among other things on the nominal lamp power and on the characteristics of the mains dimmers to be expected. By way of example, in a suitable embodiment, for a case with 230 V mains and a lamp L having a nominal power of 20 W, a resistance value of 15 kΩ is sufficient.

It is noted that the auxiliary impedance 272 is only drawing a current from mains during dimming; if the lamp is operated at a duty cycle of 100% (full nominal power), no extra losses are introduced.

Summarizing, the present invention provides a driver 100; 200 for driving a dimmable load L, which driver is powered from phase-cut mains U1 and determines the dimming state of the load on the basis of the phase of the cutting of the mains.

The driver comprises:

a load current generating device 130; 230 generating load current;

a controllable auxiliary load 170; 270 connected to an input 131; 231 of the load current generating device;

a control device 140; 240 controlling the auxiliary load.

The control device has an input 141; 241 receiving a signal indicating the momentary voltage at the driver input.

The load current generating device generates interrupted current pulses, so that the average output current corresponds to the dim command reflected by the phase cutting angle of the input mains.

The control device switches the auxiliary load on during those time periods when the output current generated by the load current generating device is zero.

An advantage of the present invention is that it assures some current to be drawn from the dimmer. This will assure that timing components in the dimmer, typically capacitors, which require current to be charged or discharged, can function properly.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appending claims.

For instance, instead of a lamp L the driver may drive another dimmable load.

In the embodiment of FIG. 3, the controller input 141 is shown as being coupled to the output 119 of the rectifier 110 in order to receive phase angle timing information; alternatively, the controller input 141 might be coupled to the rectifier input 111, since input voltage U1 also contains this information: this alternative is shown in the embodiment of FIG. 4. Conversely, for similar reasoning, the controller input 241 in the embodiment of FIG. 4 might be coupled to the rectifier output 219.

In the embodiment of FIG. 4, device 230 is implemented as an inverter, generating high frequency current as long as it receives input voltage, whereas in the embodiment of FIG. 3, the device 130 is implemented as a duty cycle controlled interruptor, generating interrupted current wherein the interruptions are controlled by controller 140. It is also possible to combine these teachings: in the embodiment of FIG. 3, the device 130 may be implemented as a duty cycle controlled inverter, generating interrupted current wherein the interruptions are controlled by controller 140 and wherein the current is high frequency current (for instance about 45 kHz). Such duty cycle controlled inverter may be capable of operating in two operative states: in a first state, the inverter is off and generates no current, while in a second state the inverter is on and generates high frequency current. The inverter is responsive to a control signal Sci from the controller 140 to be either on or off.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

The invention claimed is:

1. A driver for driving a dimmable load, the driver being powered from phase-cut input mains for determining a dimming state of the dimmable load on the basis of a phase cutting angle of the input mains, the driver comprising:

a load current generating device configured to generate load current having an adjustable duty cycle by cycling between to an active state for outputting the load current and a blocking state for blocking the load current, in response to the phase-cut input mains, the load current generating device having an output coupled to an output of the driver connected to the dimmable load;

a controllable auxiliary load connected to an input of the load current generating device; and a control device configured to control operation of the auxiliary load, the control device comprising an input coupled to receive a signal indicating a momentary voltage at an input of the driver;

wherein an average of the output current corresponds to a dimming command reflected by the phase cutting angle of the input mains; and wherein the control device is configured to switch the auxiliary load on during time periods of the adjustable duty cycle when the output current generated by the load current generating device is zero.

2. The driver according to claim 1, wherein the auxiliary load comprises a series arrangement of an impedance and a controllable switch for selectively connecting the impedance between the input of the current generating device and ground under control of the control device.

3. The driver according to claim 2, wherein the impedance comprises a resistor.

4. The driver according to claim 1, further comprising:

converting means for converting the input mains to a constant DC voltage, wherein the load current generating device is a controllable interruptor having an input coupled to an output of the converting means, and having a control input, wherein the control device further comprises a first control output for providing a first control signal to the control input of the controllable interruptor;

wherein the control device is further configured to generate the first control signal to cause the controllable interruptor to alternate between the active state for a first time duration of the duty cycle and the blocking state for a second time duration of the duty cycle; and wherein the auxiliary load is switched on during the blocking state and off during the active state.

5. The driver according to claim 1, further comprising:

converting means for converting the input mains to a constant DC voltage, wherein the load current generating device is a controllable inverter having an input coupled to an output of the converting means, and having a control input, wherein the control device further comprises a first control output for providing a first control signal to the control input of the controllable inverter;

wherein the control device is further configured to generate the first control signal to cause the controllable inverter to alternate between the active state for a first time duration and the off state for a second time duration of the duty cycle; and wherein the auxiliary load is switched on during the off state and off during the active state.

6. The driver according to claim 4, wherein the converting means comprise:

a rectifier having an input connected to the driver input for receiving the phase-cut input mains, and an output for providing rectified mains; and a DC/DC converter having an input connected to the rectifier output, and an output for providing substantially constant output voltage;

wherein the input of the load current generating device is coupled to the output of the converting means; and wherein the control device is further configured to set a ratio between the first time duration and the second time duration of the duty cycle based on phase cutting angle information in one of the rectified mains or the input mains.

7. The driver according to claim 6, wherein the control device has an input coupled to one of the rectifier output or the rectifier input via a resistive divider.

8. The driver according to claim 4, wherein the control device has a second control output for providing a second control signal to a control input of the controllable auxiliary load.

9. The driver according to claim 1, further comprising:

a rectifier having an input connected to the driver input for phase-cut input mains, and an output for providing rectified mains;

wherein the load current generating device is an inverter having an input coupled to the rectifier output, and the control device comprises a control output for providing a control signal to a control input of the controllable auxiliary load.

10. The driver according to claim 9, wherein the control device comprises an input coupled to one of the rectifier output or the rectifier input via a resistive divider for receiving a signal representing the phase cutting angle;

wherein the control device is further configured to monitor zero-crossings of the phase-cut input mains via the received signal, and to switch on the auxiliary load when the phase-cut mains is approaching zero and to switch off the auxiliary load when the phase-cut input mains is rising from zero.

11. A driver for driving a dimmable load, comprising:

a rectifier configured to receive phase-cut input mains from a mains dimmer and to output rectified mains;

a load current generating device configured to output a load current having an adjustable duty cycle by cycling between to a conductive state for outputting the load current and a non-conductive state for outputting no load current in response to the rectified mains, the duty cycle corresponding to a dimming level of the mains dimmer;

a controllable auxiliary load comprising a resistance and a switch configured to selectively connect the resistance to an input of the load current generating device; and a control device configured to generate a switch control signal for controlling operation of the controllable auxiliary load in response to one of the phase-cut input mains and the rectified mains, such that the resistance is connected to the input of the load current generating device when the load current generating device is in the non-conductive state, while cycling between the conductive state and the non-conductive state, to assure a minimum current is drawn from the mains dimmer.

12. The driver of claim 11, wherein the duty cycle determines an average value of the load current provided to the dimmable load.

13. The driver of claim 11, wherein the switch of the controllable auxiliary load cycles between to a switch conductive state for connecting the resistance to the input of the load current generating device and a switch non-conductive state for disconnecting the resistance from the input of the load current generating device in response to the switch control signal.

14. The driver of claim 13, wherein the load current generating device comprises an inverter connected to an output of the rectifier for receiving the rectified mains.

15. The driver of claim 13, further comprising:

a DC/DC converter connected between an output of the rectifier and an input of the load current generating device, the switch of the controllable auxiliary load being configured to selectively connect the resistance to an output of the DC/DC converter in addition to the input of the load current generating device.

16. The driver of claim 15, wherein the load current generating device comprises a controllable interrupter connected to the output of the DC/DC converter for receiving a constant DC voltage, and wherein the control device is further configured to generate an interrupter control signal for controlling operation of the controllable interrupter, in response to one of the phase-cut input mains and the rectified mains, to output the load current at the duty cycle.

17. The driver of claim 15, wherein the load current generating device comprises a controllable inverter connected to the output of the DC/DC converter for receiving a constant DC voltage, wherein the control device is further configured to generate an inverter control signal for controlling operation of the controllable inverter, in response to one of the phase-cut input mains and the rectified mains, to output the load current at the duty cycle.

* * * * *